US012753764B2

(12) United States Patent
Inatsu et al.

(10) Patent No.: US 12,753,764 B2
(45) Date of Patent: Oct. 6, 2026

(54) ELECTRIC COMPRESSOR

(71) Applicant: KABUSHIKI KAISHA TOYOTA JIDOSHOKKI, Kariya (JP)

(72) Inventors: Kai Inatsu, Kariya (JP); Yuya Hattori, Kariya (JP); Yoshihiko Sato, Kariya (JP); Keita Jinno, Kariya (JP); Ami Fujiwara, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 19/305,186

(22) Filed: Aug. 20, 2025

(65) Prior Publication Data

US 2026/0055770 A1 Feb. 26, 2026

(30) Foreign Application Priority Data

Aug. 26, 2024 (JP) ..... 2024-144205
Feb. 14, 2025 (JP) ..... 2025-022222

(51) Int. Cl.
*F04C 29/04* (2006.01)
*F04C 18/02* (2006.01)

(52) U.S. Cl.
CPC ..... *F04C 29/045* (2013.01); *F04C 18/0215* (2013.01)

(58) Field of Classification Search
CPC ..... F04C 18/0215; F04C 2240/30; F04C 2240/40; F04C 23/008; F04C 29/045; F04C 29/12; F04C 29/026; F04C 18/0253; F04C 2240/50; F04C 2240/60; F04C 29/028; F04C 18/0238; F04C 18/0261; F04C 18/0269; F04C 18/0276; F04C 2210/26; F04C 2230/60; F04C 2240/54; F04C 2240/80; F04C 2240/807; F04C 2240/809; F04C 23/02; F04C 27/00; F04C 27/009;
(Continued)

(56) References Cited

U.S. PATENT DOCUMENTS

2004/0126252 A1* 7/2004 Abe ..... F04C 29/026 417/410.5
2004/0191083 A1 9/2004 Gennami et al.
(Continued)

FOREIGN PATENT DOCUMENTS

JP 2004-301089 A 10/2004

*Primary Examiner* — Mark A Laurenzi
*Assistant Examiner* — Benjamin Doyle
(74) *Attorney, Agent, or Firm* — Sughrue Mion, PLLC

(57) ABSTRACT

An electric compressor includes a rotary shaft and a housing having a motor chamber and a suction passage. In an axial view of the rotary shaft, a second imaginary line intersects an inner peripheral surface of the housing at a first intersection point. A third imaginary line intersects the inner peripheral surface of the housing at a second intersection point. A fourth imaginary line passes through the first and second intersection points located below an axis of the rotary shaft in a vertical direction. A part of the motor chamber below the fourth imaginary line in the vertical direction and surrounded by the inner peripheral surface of the housing and the fourth imaginary line serves as a reservoir. The reservoir stores a refrigerant liquified in the motor chamber while restricting the refrigerant liquified from being introduced into a compression chamber from the motor chamber through the suction passage.

8 Claims, 4 Drawing Sheets

(58) Field of Classification Search
CPC ..... F04C 28/06; F04C 29/0035; F04C 29/02; F04C 29/023; F04C 29/042; F04C 29/065; F04C 29/068; F04C 29/128; F04B 39/12
USPC ..... 417/410.5
See application file for complete search history.

(56) References Cited

U.S. PATENT DOCUMENTS

| | | | | |
|---|---|---|---|---|
| 2009/0285708 | A1* | 11/2009 | Yokoi | F04C 29/026 418/55.6 |
| 2009/0304539 | A1* | 12/2009 | Kii | F04C 23/008 418/55.6 |
| 2012/0263615 | A1* | 10/2012 | Iizuka | F04C 18/0269 418/55.3 |
| 2019/0264689 | A1* | 8/2019 | Park | F04C 29/12 |
| 2022/0235771 | A1* | 7/2022 | Yamamoto | F04C 18/0215 |
| 2022/0268282 | A1* | 8/2022 | Lee | F04C 18/0261 |
| 2022/0316475 | A1* | 10/2022 | Lee | F04C 29/128 |
| 2023/0258185 | A1* | 8/2023 | Hattori | F04C 27/00 417/410.5 |
| 2023/0392599 | A1* | 12/2023 | Hattori | F04C 23/02 |

* cited by examiner

ELECTRIC COMPRESSOR

This application claims priority to Japanese Patent Application No. 2024-144205 filed on Aug. 26, 2024 and Japanese Patent Application No. 2025-022222 filed on Feb. 14, 2025, the entire disclosure of which is incorporated herein by reference.

The present disclosure relates to an electric compressor.

BACKGROUND ART

A known electric compressor, for example, disclosed in Japanese Patent Application Publication No. 2004-301089, includes a rotary shaft, a motor, a compression part, and a housing. The motor is configured to rotate the rotary shaft. The compression part is driven by rotation of the rotary shaft. The compression part has a compression chamber for compressing a refrigerant. The housing rotatably supports the rotary shaft. The housing has a motor chamber and a suction passage. The motor chamber accommodates the motor. The refrigerant is introduced into the motor chamber from the outside of the electric compressor. The refrigerant in the motor chamber is introduced into the compression chamber through the suction passage.

However, in such an electric compressor, the refrigerant in the motor chamber may be cooled and liquefied when the electric compressor is stopped. If the liquid refrigerant is introduced into the compression chamber through the suction passage upon activation of the electric compressor, the liquid refrigerant may be compressed in the compression chamber. The compression of the liquid refrigerant may abnormally increase the pressure in the compression chamber. This may decrease the durability of the compression part, thereby decreasing the reliability of the electric compressor.

The present disclosure, which has been made in light of the above described problem, is directed to providing an electric compressor that has an increased reliability.

SUMMARY

In accordance with an aspect of the present disclosure, there is provided an electric compressor that includes: a rotary shaft; a motor configured to rotate the rotary shaft; a compression part driven by rotation of the rotary shaft and having a compression chamber for compressing a refrigerant; and a housing. The housing has: a motor chamber in which the motor is accommodated and into which the refrigerant is introduced from outside of the electric compressor; and a suction passage through which the refrigerant in the motor chamber is introduced into the compression chamber. The housing rotatably supports the rotary shaft. The motor chamber is defined by an inner peripheral surface of the housing. In an axial view of the rotary shaft, a first imaginary line intersects an axis of the rotary shaft in a vertical direction. A second imaginary line intersects the axis of the rotary shaft and is inclined at an angle of 30 degrees to the first imaginary line in one direction along a circumferential direction of the rotary shaft. The second imaginary line intersects the inner peripheral surface of the housing at a first intersection point located below the axis of the rotary shaft in the vertical direction. A third imaginary line intersects the axis of the rotary shaft and is inclined at an angle of 30 degrees to the first imaginary line in the other direction along the circumferential direction of the rotary shaft. The third imaginary line intersects the inner peripheral surface of the housing at a second intersection point located below the axis of the rotary shaft in the vertical direction. A fourth imaginary line passes through the first intersection point and the second intersection point and extends in a horizontal direction. A part of the motor chamber below the fourth imaginary line in the vertical direction and surrounded by the inner peripheral surface of the housing and the fourth imaginary line serves as a reservoir. The reservoir stores the refrigerant liquified in the motor chamber while restricting the refrigerant liquified from being introduced into the compression chamber from the motor chamber through the suction passage.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

The following will describe an embodiment of an electric compressor with reference to accompanying FIGS. 1 to 5. The electric compressor of the embodiment is applied, for example, to a vehicle air conditioner.

Figure 1:
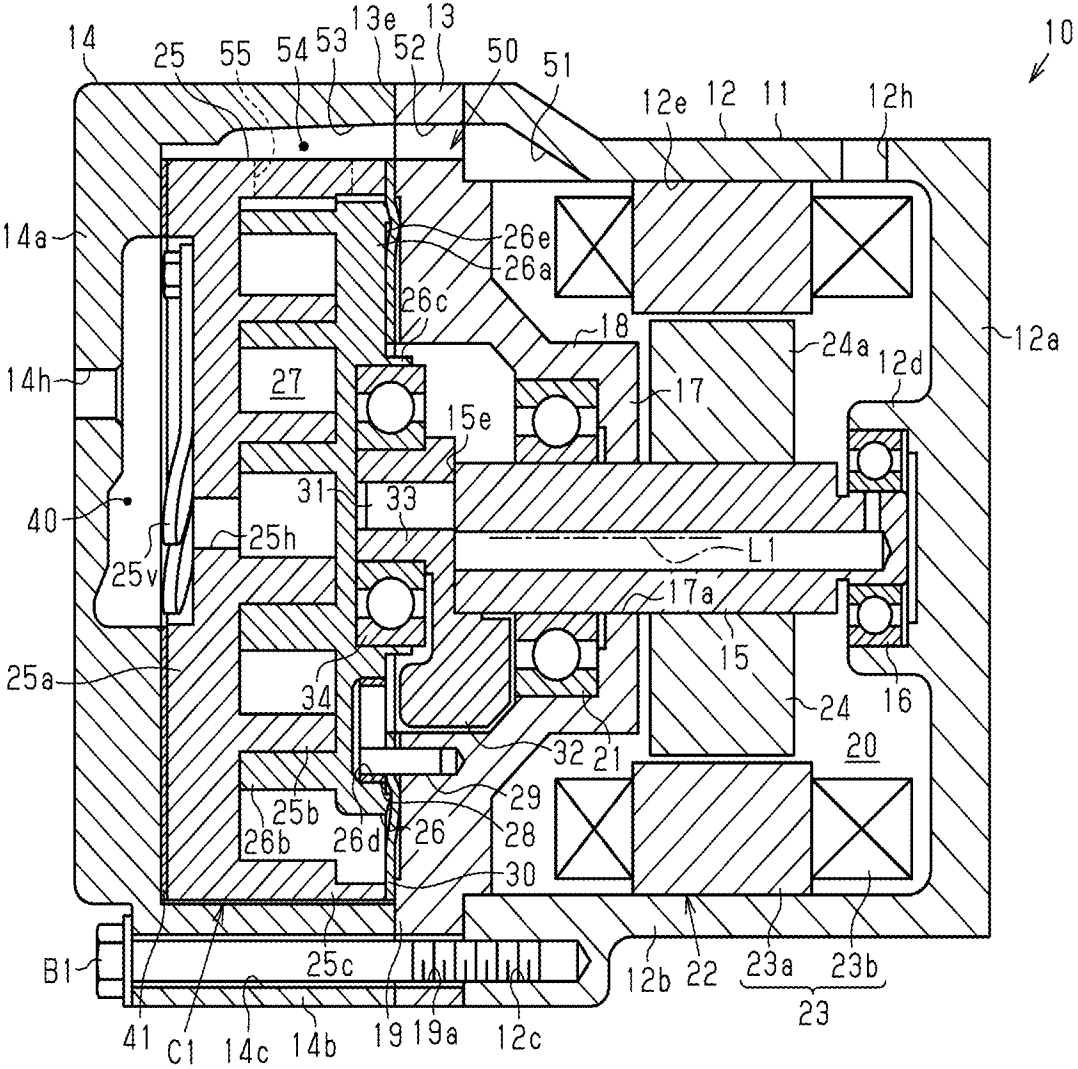
FIG. 1 is a sectional view of an electric compressor according to an embodiment of the present disclosure.

FIG. 1 illustrates an electric compressor 10 that includes a housing 11 having a cylindrical shape. The housing 11 includes a motor housing 12, a shaft support housing 13, and a discharge housing 14. The motor housing 12, the shaft support housing 13, and the discharge housing 14 are each made of a metal material. The motor housing 12, the shaft support housing 13, and the discharge housing 14 are each made of aluminum, for example. The electric compressor 10 includes a rotary shaft 15. The rotary shaft 15 is accommodated in the housing 11.

The motor housing 12 includes a motor housing end wall 12*a* having a plate-like shape, and a motor housing peripheral wall 12*b* having a cylindrical shape. The motor housing peripheral wall 12*b* extends from the outer peripheral portion of the motor housing end wall 12*a*. The axial direction of the motor housing peripheral wall 12*b* corresponds to the axial direction of the rotary shaft 15.

The motor housing 12 has a plurality of female threaded holes 12*c*. Specifically, in this embodiment, the motor housing 12 has six female threaded holes 12*c*. The female threaded holes 12*c* are formed at the open end of the motor housing peripheral wall 12*b*. The six female threaded holes 12*c* are arranged at equal intervals in the circumferential direction of the motor housing peripheral wall 12*b*. For the sake of explanation, FIG. 1 illustrates only one of the female threaded holes 12*c*.

The motor housing 12 has an inlet 12*h*. The refrigerant is introduced from the outside through the inlet 12*h*. In this embodiment, propane serves as the refrigerant. The inlet 12*h* is formed in a portion of the motor housing peripheral wall 12*b* that is adjacent to the motor housing end wall 12*a*. The inside and the outside of the motor housing 12 are connected via the inlet 12*h*.

The motor housing 12 has a boss 12*d* having a cylindrical shape. The boss 12*d* extends from the center portion of the inner surface of the motor housing end wall 12*a*. The rotary shaft 15 has a first end and a second end that define the rotary shaft 15 in the axial direction of the rotary shaft 15, and the first end of the rotary shaft 15 is inserted in the boss 12*d*.

The electric compressor 10 includes a bearing 16. The bearing 16 is, for example, a rolling bearing. The bearing 16 is disposed between the inner peripheral surface of the boss 12*d* and the outer peripheral surface of the first end of the rotary shaft 15. The first end of the rotary shaft 15 is rotatably supported by the motor housing 12 via the bearing 16.

The shaft support housing 13 includes a shaft support housing end wall 17 having a plate-like shape, and a shaft support housing peripheral wall 18 having a cylindrical shape. The shaft support housing peripheral wall 18 extends from the outer peripheral portion of the shaft support housing end wall 17. The axial direction of the shaft support housing peripheral wall 18 corresponds to the axial direction of the rotary shaft 15.

The shaft support housing 13 includes a flange wall 19 having a ring shape. The flange wall 19 is located at the distal end of the shaft support housing peripheral wall 18 that is distant from the shaft support housing end wall 17, and extends from the outer peripheral surface of the shaft support housing peripheral wall 18 outwardly in the radial direction of the rotary shaft 15.

The shaft support housing 13 has an insertion hole 17*a* having a circular hole shape. The insertion hole 17*a* is formed in the center portion of the shaft support housing end wall 17. The insertion hole 17*a* is formed through the shaft support housing end wall 17 in the thickness direction of the shaft support housing end wall 17. The rotary shaft 15 is inserted through the insertion hole 17*a*. The rotary shaft 15 has, at the second end thereof, an end face 15*e* that is located inside of the shaft support housing peripheral wall 18.

The electric compressor 10 includes a bearing 21. The bearing 21 is, for example, a rolling bearing. The bearing 21 is disposed between the inner peripheral surface of the shaft support housing peripheral wall 18 and the outer peripheral surface of the rotary shaft 15. The rotary shaft 15 is rotatably supported by the shaft support housing 13 via the bearing 21. Accordingly, the rotary shaft 15 is rotatably supported by the shaft support housing 13. That is, the rotary shaft 15 is rotatably supported by the housing 11.

The shaft support housing 13 has a plurality of bolt insertion holes 19*a*. Specifically, in this embodiment, the shaft support housing 13 has six bolt insertion holes 19*a*. The bolt insertion holes 19*a* are formed through the outer peripheral portion of the flange wall 19. The six bolt insertion holes 19*a* are arranged at equal intervals in the circumferential direction of the flange wall 19. The bolt insertion holes 19*a* are formed through the flange wall 19 in the thickness direction of the flange wall 19. The bolt insertion holes 19*a* of the flange wall 19 are communicated with the female threaded holes 12*c* of the motor housing 12, respectively. For the sake of explanation, FIG. 1 illustrates only one of the bolt insertion holes 19*a*.

The electric compressor 10 has a motor chamber 20. The motor chamber 20 is defined by the motor housing 12 and the shaft support housing 13. Specifically, an opening of the motor housing peripheral wall 12*b* of the motor chamber 20 is closed by the shaft support housing 13 so that the motor housing 12 cooperates with the shaft support housing 13 to define the motor chamber 20. Accordingly, the housing 11 has the motor chamber 20. An inner peripheral surface 12*e* of the motor housing peripheral wall 12*b* serves as the inner peripheral surface of the housing 11 that defines the motor chamber 20 in an axial view of the rotary shaft 15. The motor chamber 20 is communicated with the inlet 12*h*. The refrigerant is introduced into the motor chamber 20 through the inlet 12*h*. That is, the refrigerant is introduced into the motor chamber 20 from the outside of the electric compressor 10. The motor chamber 20 is a suction pressure region.

The electric compressor 10 includes a motor 22. The motor 22 is accommodated in the motor chamber 20. The motor 22 includes a cylindrical stator 23 and a cylindrical rotor 24. The rotor 24 is disposed inside the stator 23. The rotor 24 rotates together with the rotary shaft 15. The stator 23 surrounds the rotor 24. The rotor 24 includes a rotor core 24*a* fixed to the rotary shaft 15, and a plurality of permanent magnets (not illustrated) disposed in the rotor core 24*a*.

The stator 23 includes a cylindrical stator core 23*a* and a motor coil 23*b*. The stator core 23*a* is fixed to the inner peripheral surface 12*e* of the motor housing peripheral wall 12*b* of the motor housing 12. The motor coil 23*b* is wound around the stator core 23*a*. The motor coil 23*b* receives power controlled by an inverter (not illustrated), so that the rotor 24 rotates. The rotor 24 rotates together with the rotary shaft 15. That is, the motor 22 is configured to rotate the rotary shaft 15.

The electric compressor 10 includes a compression part C1. The compression part C1 includes a fixed scroll 25 and an orbiting scroll 26. That is, the electric compressor 10 includes the fixed scroll 25 and the orbiting scroll 26. The compression part C1 is a scroll compression mechanism. The orbiting scroll 26 orbits relative to the fixed scroll 25 with the rotation of the rotary shaft 15.

Figure 2:
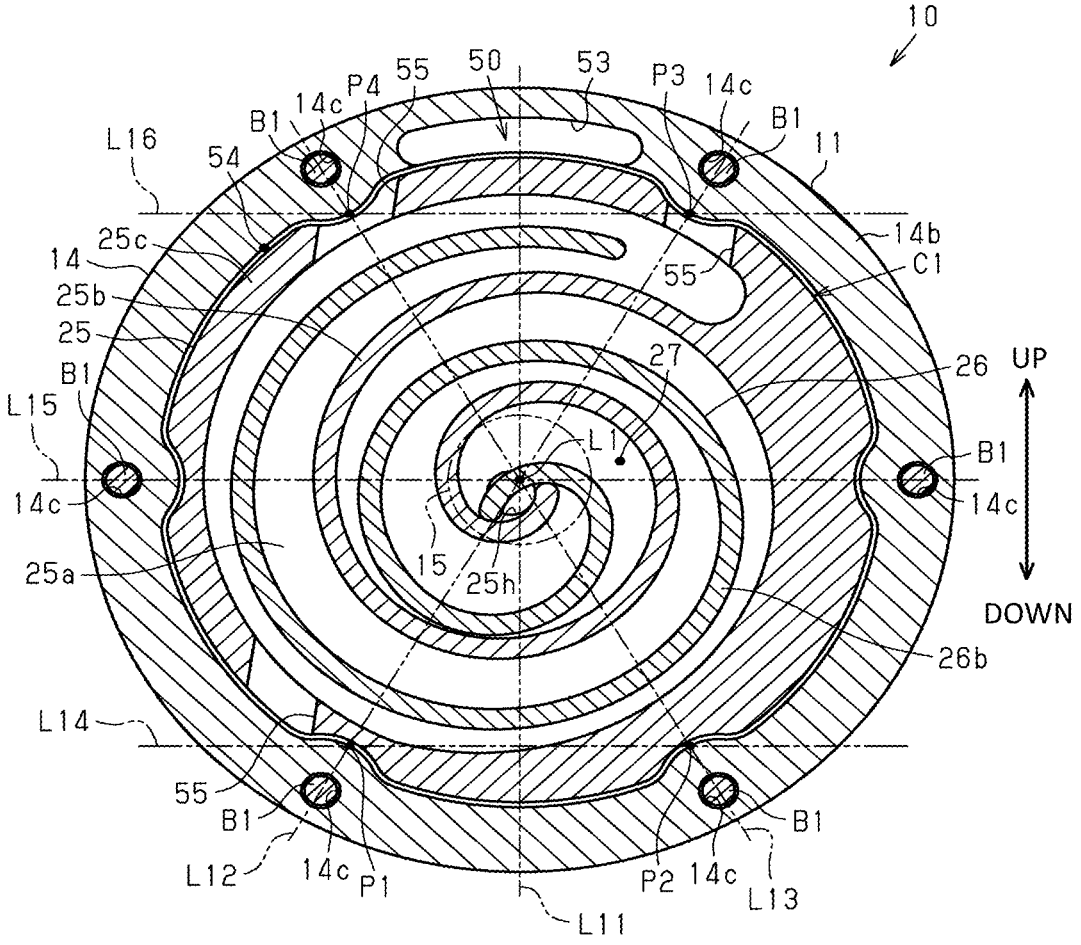
FIG. 2 is a sectional view of the electric compressor.

As illustrated in FIGS. 1 and 2, the fixed scroll 25 includes a fixed scroll base plate 25*a*, a fixed scroll spiral wall 25*b*, and a fixed scroll peripheral wall 25*c*. The fixed scroll base plate 25*a* has a disc shape. The fixed scroll base plate 25*a* has, at the center portion thereof, a discharge port 25*h*. The discharge port 25*h* has a circular hole shape. The discharge port 25*h* is formed through the fixed scroll base plate 25*a* in the thickness direction of the fixed scroll base plate 25*a*. The 20) fixed scroll spiral wall 25*b* extends from the fixed scroll base plate 25*a*. The fixed scroll peripheral wall 25*c* extends from the outer peripheral portion of the fixed scroll base plate 25*a*. The fixed scroll peripheral wall 25*c* surrounds the fixed scroll spiral wall 25*b*.

As illustrated in FIG. 1, the electric compressor 10 includes a valve mechanism 25*v*. The valve mechanism 25*v* is attached to the end face of the fixed scroll base plate 25*a* that faces away from the fixed scroll spiral wall 25*b*. The valve mechanism 25*v* is configured to open and close the discharge port 25*h*.

The orbiting scroll 26 includes an orbiting scroll base plate 26*a* and an orbiting scroll spiral wall 26*b*. The orbiting scroll base plate 26*a* has a disc shape. The orbiting scroll base plate 26*a* faces the fixed scroll base plate 25*a*. The orbiting scroll spiral wall 26*b* extends from the orbiting scroll base plate 26*a* toward the fixed scroll base plate 25*a*. The orbiting scroll spiral wall 26*b* meshes with the fixed scroll spiral wall 25*b*. The orbiting scroll 26 is located inside the fixed scroll peripheral wall 25*c*. The orbiting scroll 26 orbits inside the fixed scroll peripheral wall 25*c*. The distal end face of the fixed scroll spiral wall 25*b* is in contact with the orbiting scroll base plate 26*a*. The distal end face of the orbiting scroll spiral wall 26*b* is in contact with the fixed scroll base plate 25*a*.

The electric compressor 10 has a compression chamber 27. The fixed scroll base plate 25*a*, the fixed scroll spiral wall 25*b*, the orbiting scroll base plate 26*a*, and the orbiting scroll spiral wall 26*b* cooperate to define the compression chamber 27. That is, the fixed scroll 25 and the orbiting scroll 26 cooperate to define the compression chamber 27. The compression chamber 27 takes in the refrigerant from the outside of the electric compressor 10 and compresses the refrigerant. Thus, the compression part C1 has the compression chamber 27.

The orbiting scroll base plate 26*a* includes a boss 26*c* having a cylindrical shape. The boss 26*c* extends toward the inside of the shaft support housing peripheral wall 18 of the shaft support housing 13 from an end face 26*e* of the orbiting scroll base plate 26*a* that faces away from the fixed scroll base plate 25*a*. The fixed scroll base plate 25*a* is disposed such that the orbiting scroll base plate 26*a* is located between the shaft support housing 13 and the fixed scroll base plate 25*a*. The axial direction of the boss 26*c* corresponds to the axial direction of the rotary shaft 15. The orbiting scroll base plate 26*a* has a plurality of grooves 26*d*. The grooves 26*d* are formed in the end face 26*e* of the orbiting scroll base plate 26*a* and around the boss 26*c*. The grooves 26*d* are arranged at predetermined intervals in the circumferential direction of the rotary shaft 15. For the sake of explanation, FIG. 1 illustrates only one of the grooves 26*d*. A ring member 28 having a ring shape is fitted in each of the grooves 26*d*. A pin 29 is inserted in the ring member 28. The pin 29 protrudes from an end face 13*e* of the shaft support housing 13 that faces the orbiting scroll 26.

The electric compressor 10 includes an elastic plate 30. The elastic plate 30 has an annular shape. The outer peripheral portion of the elastic plate 30 is disposed between and held by the end face of the open end of the fixed scroll peripheral wall 25*c* and the end face 13*e* of the shaft support housing 13. The elastic plate 30 continuously urges the orbiting scroll 26 toward the fixed scroll 25.

The electric compressor 10 includes an eccentric shaft 31. The eccentric shaft 31 extends from the end face 15*e* of the rotary shaft 15 toward the orbiting scroll 26 at a position eccentric from an axis L1 of the rotary shaft 15. The eccentric shaft 31 is formed integrally with the rotary shaft 15. The axial direction of the eccentric shaft 31 corresponds to the axial direction of the rotary shaft 15. The eccentric shaft 31 is inserted in the boss 26*c*.

The electric compressor 10 includes a balance weight 32 and a bushing 33. The bushing 33 is fitted on the outer peripheral surface of the eccentric shaft 31. The balance weight 32 is formed integrally with the bushing 33. The balance weight 32 is accommodated in the shaft support housing peripheral wall 18 in the shaft support housing 13. The orbiting scroll 26 is supported by the eccentric shaft 31 via the bushing 33 and the rolling bearing 34 so that the orbiting scroll 26 rotates relative to the eccentric shaft 31.

The rotation of the rotary shaft 15 is transmitted to the orbiting scroll 26 via the eccentric shaft 31, the bushing 33, and the rolling bearing 34. The pin 29 comes into contact with the inner peripheral surface of the ring member 28 to only allow the orbital motion of the orbiting scroll 26 while preventing the rotation of the orbiting scroll 26 on its axis. Accordingly, the orbiting scroll 26 orbits with the orbiting scroll spiral wall 26*b* in contact with the fixed scroll spiral wall 25*b*. The volume of the compression chamber 27 decreases with the orbital motion of the orbiting scroll 26 so as to compress the refrigerant in the compression chamber 27. The orbiting scroll 26 orbits inside the fixed scroll peripheral wall 25*c* with the rotation of the rotary shaft 15. The balance weight 32 counterbalances a centrifugal force that acts on the orbiting scroll 26 when the orbiting scroll 26 makes the orbital motion. This reduces the unbalanced mass of the orbiting scroll 26.

The discharge housing 14 includes a discharge housing end wall 14*a* having a plate-like shape, and a discharge housing peripheral wall 14*b* having a cylindrical shape. The discharge housing peripheral wall 14*b* extends from the outer peripheral portion of the discharge housing end wall 14*a*. The axial direction of the discharge housing peripheral wall 14*b* corresponds to the axial direction of the rotary shaft 15. The discharge housing peripheral wall 14*b* surrounds the fixed scroll peripheral wall 25*c*. Thus, the discharge housing peripheral wall 14*b* surrounds the fixed scroll 25. Accordingly, the fixed scroll 25 is accommodated in the housing 11.

As illustrated in FIGS. 1 and 2, the discharge housing 14 has a plurality of bolt insertion holes 14*c*. Specifically, in this embodiment, the discharge housing 14 has six bolt insertion holes 14*c*. Each of the bolt insertion holes 14*c* is formed through the discharge housing peripheral wall 14*b* in the axial direction of the discharge housing peripheral wall 14*b*. For the sake of explanation, FIG. 1 illustrates only one of the bolt insertion holes 14*c*. The bolt insertion holes 14*c* are communicated with the bolt insertion holes 19*a* of the flange wall 19, respectively.

As illustrated in FIG. 1, bolts B1 are screwed in the female threaded holes 12*c* of the motor housing 12 through the bolt insertion holes 14*c* and the bolt insertion holes 19*a* of the flange wall 19, respectively. Accordingly, the shaft support housing 13 is connected to the motor housing peripheral wall 12*b* of the motor housing 12, and the discharge housing 14 is connected to the motor housing peripheral wall 12*b* of the motor housing 12 via the flange wall 19 of the shaft support housing 13. The motor housing 12, the shaft support housing 13, and the discharge housing 14 are arranged in this order in the axial direction of the rotary shaft 15. The flange wall 19 of the shaft support housing 13 is disposed between and held by the discharge housing peripheral wall 14*b* of the discharge housing 14 and the motor housing peripheral wall 12*b* of the motor housing 12.

The fixed scroll peripheral wall 25*c* of the fixed scroll 25 is disposed between and held by the discharge housing end wall 14*a* of the discharge housing 14 and the shaft support housing 13 in the axial direction of the discharge housing peripheral wall 14*b* by the axial force of each bolt B1. Accordingly, the fixed scroll 25 is fixed to the housing 11.

The electric compressor 10 has a discharge chamber 40. The discharge chamber 40 is defined by the discharge housing 14 so that the discharge chamber 40 is located between the discharge housing end wall 14*a* of the discharge housing 14 and the fixed scroll base plate 25*a*. The refrigerant compressed in the compression chamber 27 is discharged into the discharge chamber 40 through the discharge port 25*h*. A gasket 41 is disposed between the discharge housing end wall 14*a* of the discharge housing 14 and the fixed scroll base plate 25*a* to seal around the discharge chamber 40.

The discharge housing 14 has an outlet 14*h*. The outlet 14*h* is formed in the discharge housing end wall 14*a* of the discharge housing 14. The outlet 14*h* is communicated with the discharge chamber 40. The refrigerant in the discharge chamber 40 is discharged to the outside of the discharge housing 14 through the outlet 14*h*.

The housing 11 has a suction passage 50. The refrigerant in the motor chamber 20 is introduced into the compression chamber 27 through the suction passage 50. The suction passage 50 includes a suction groove 51, a communication hole 52, a communication groove 53, an annular passage 54, and a plurality of suction ports 55.

Figure 3:
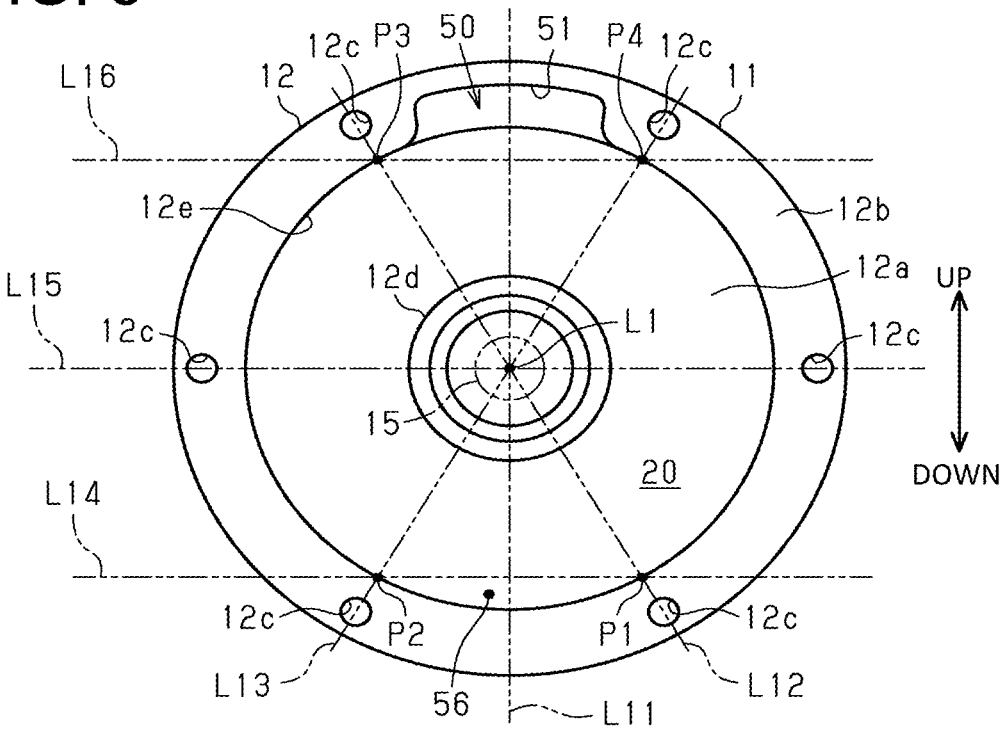
FIG. 3 is a front view of a motor housing.
Figure 4:
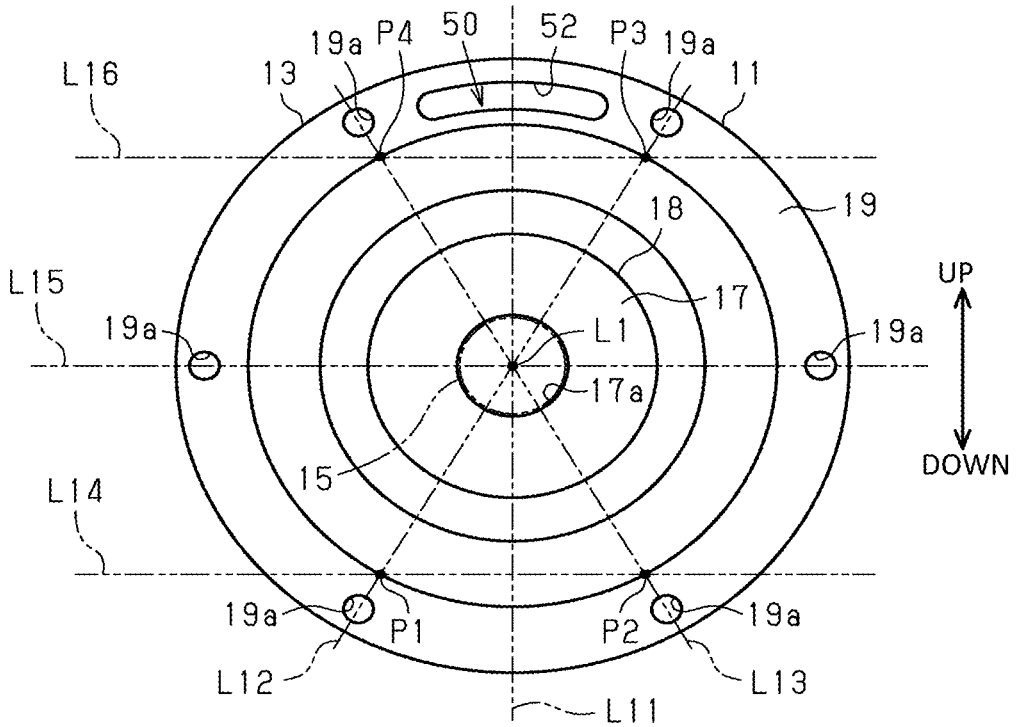
FIG. 4 is a front view of a shaft support housing.

As illustrated in FIGS. 3 and 4, in the axial view of the rotary shaft 15, an imaginary line that intersects the axis L1 of the rotary shaft 15 serves as a first imaginary line L11. An imaginary line that intersects the axis L1 of the rotary shaft 15 and is inclined at an angle of 30 degrees to the first imaginary line L11 in one direction along the circumferential direction of the rotary shaft 15 serves as a second imaginary line L12. An imaginary line that intersects the axis L1 of the rotary shaft 15 and is inclined at an angle of 30 degrees to the first imaginary line L11 in the other direction along the circumferential direction of the rotary shaft 15 serves as a third imaginary line L13.

As illustrated in FIG. 3, in the axial view of the rotary shaft 15, the second imaginary line L12 intersects the inner peripheral surface 12*e* of the motor housing peripheral wall 12*b*, which defines the motor chamber 20, at a first intersection point P1 located below the axis L1 of the rotary shaft 15 in the vertical direction. The third imaginary line L13 intersects the inner peripheral surface 12*e* of the motor housing peripheral wall 12*b* at a second intersection point P2 located below the axis L1 of the rotary shaft 15 in the vertical direction. An imaginary line that passes through the first intersection point P1 and the second intersection point P2 and extends in the horizontal direction serves as a fourth imaginary line L14.

An imaginary line that intersects the axis L1 of the rotary shaft 15 and extends in the horizontal direction serves as a fifth imaginary line L15. The second imaginary line L12 also intersects the inner peripheral surface 12*e* of the motor housing peripheral wall 12*b* at a third intersection point P3 located above the axis L1 of the rotary shaft 15 in the vertical direction. The third imaginary line L13 intersects the inner peripheral surface 12*e* of the motor housing peripheral wall 12*b* at a fourth intersection point P4 located above the axis L1 of the rotary shaft 15 in the vertical direction. An imaginary line that passes through the third intersection point P3 and the fourth intersection point P4 and extends in the horizontal direction serves as a sixth imaginary line L16.

The single suction groove 51 is formed in the inner peripheral surface 12*e* of the motor housing peripheral wall 12*b* of the motor housing 12. Specifically, the suction groove 51 is formed in the inner peripheral surface 12*e* at an open end of the motor housing peripheral wall 12*b*. The suction groove 51 opens at the open end of the motor housing peripheral wall 12*b*. In the axial view of the rotary shaft 15, the suction groove 51 is located in a portion of the motor housing peripheral wall 12*b* located above the sixth imaginary line L16 in the vertical direction. That is, in the axial view of the rotary shaft 15, the suction groove 51 is located in a portion of the motor housing peripheral wall 12*b* above the fifth imaginary line L15 in the vertical direction. Accordingly, in the axial view of the rotary shaft 15, the suction groove 51 is located in a portion of the motor housing peripheral wall 12*b* located above the fourth imaginary line L14 in the vertical direction.

As illustrated in FIG. 4, the single communication hole 52 is formed in the outer peripheral portion of the flange wall 19 of the shaft support housing 13. The communication hole 52 is formed through the flange wall 19 in the thickness direction of the flange wall 19. The communication hole 52 is communicated with the suction groove 51. In the axial view of the rotary shaft 15, the communication hole 52 is located in a portion of the flange wall 19 of the shaft support housing 13 located above the sixth imaginary line L16 in the vertical direction. That is, in the axial view of the rotary shaft 15, the communication hole 52 is located in a portion of the flange wall 19 of the shaft support housing 13 located above the fifth imaginary line L15 in the vertical direction. Accordingly, in the axial view of the rotary shaft 15, the communication hole 52 is located in a portion of the flange wall 19 of the shaft support housing 13 located above the fourth imaginary line L14 in the vertical direction.

As illustrated in FIGS. 1 and 2, the single communication groove 53 is formed in the inner peripheral surface of the discharge housing peripheral wall 14*b* of the discharge housing 14. As illustrated in FIG. 1, the communication groove 53 is communicated with the communication hole 52.

As illustrated in FIG. 2, in the axial view of the rotary shaft 15, the communication groove 53 is located in a portion of the discharge housing peripheral wall 14*b* located above the sixth imaginary line L16 in the vertical direction. That is, in the axial view of the rotary shaft 15, the communication groove 53 is located in a portion of the discharge housing peripheral wall 14*b* located above the fifth imaginary line L15 in the vertical direction. Accordingly, in the axial view of the rotary shaft 15, the communication groove 53 is located in a portion of the discharge housing peripheral wall 14*b* located above the fourth imaginary line L14 in the vertical direction.

The annular passage 54 is formed between the fixed scroll peripheral wall 25*c* and the discharge housing peripheral wall 14*b* of the discharge housing 14. The annular passage 54 is communicated with the suction groove 51 through the communication hole 52 and the communication groove 53. Accordingly, the suction groove 51 is communicated with the annular passage 54 through the communication hole 52.

In this embodiment, the three suction ports 55 are formed in the fixed scroll peripheral wall 25*c*. The suction ports 55 are formed through the fixed scroll peripheral wall 25*c* in the thickness direction of the fixed scroll peripheral wall 25*c*. The suction ports 55 are communicated with the annular passage 54. The suction ports 55 are communicated with the outermost peripheral portion of the compression chamber 27. In the axial view of the rotary shaft 15, the suction ports 55 are located in a portion of the fixed scroll peripheral wall 25*c* located above the fourth imaginary line L14 in the vertical direction. The suction passage 50 is formed in at least the shaft support housing 13 so that the motor chamber 20 is communicated with the compression chamber 27.

As illustrated in FIG. 1, the refrigerant in the motor chamber 20 is introduced into the compression chamber 27 through the suction groove 51, the communication hole 52, the communication groove 53, the annular passage 54, and the suction ports 55. Accordingly, the refrigerant is introduced from the suction groove 51 into the compression chamber 27 through the suction ports 55. The introduced refrigerant is compressed in the compression chamber 27 by the orbital motion of the orbiting scroll 26. In this manner, the compression part C1 is driven by the rotation of the rotary shaft 15 and compresses the refrigerant introduced in the compression chamber 27.

As illustrated in FIG. 3, the electric compressor 10 includes a reservoir 56. The reservoir 56 is located in the motor chamber 20. The reservoir 56 stores the refrigerant liquified (i.e., the liquid refrigerant) in the motor chamber 20 while restricting the liquid refrigerant from being introduced into the compression chamber 27 from the motor chamber 20 through the suction passage 50. In the axial view of the rotary shaft 15, a part of the motor chamber 20 below the sixth imaginary line L16 in the vertical direction and surrounded by the inner peripheral surface 12*e* of the motor housing peripheral wall 12*b* and the sixth imaginary line L16 serves as the reservoir 56. That is, in the axial view of the rotary shaft 15, a part of the motor chamber 20 below the fifth imaginary line L15 in the vertical direction and surrounded by the inner peripheral surface 12*e* of the motor housing peripheral wall 12*b* and the fifth imaginary line L15 serves as the reservoir 56. Accordingly, in the axial view of the rotary shaft 15, a part of the motor chamber 20 below the fourth imaginary line L14 in the vertical direction and surrounded by the inner peripheral surface 12*e* of the motor housing peripheral wall 12*b* and the fourth imaginary line L14 serves as the reservoir 56. The suction groove 51 is located above the reservoir 56 in the vertical direction. That is, the suction passage 50 is located above the reservoir 56 in the vertical direction.

The following will describe the operation of the electric compressor according to the present embodiment.

In the electric compressor 10, the refrigerant in the motor chamber 20 may be cooled and liquefied when the electric compressor 10 is stopped. However, in the axial view of the rotary shaft 15, the suction groove 51 of the electric compressor 10 is located in a portion of the motor housing peripheral wall 12*b* located above the sixth imaginary line L16 in the vertical direction. Also, in the axial view of the rotary shaft 15, a part of the motor chamber 20 below the sixth imaginary line L16 in the vertical direction and surrounded by the inner peripheral surface 12*e* of the motor housing peripheral wall 12*b* and the sixth imaginary line L16 serves as the reservoir 56. This configuration allows the reservoir 56 to store the liquid refrigerant liquified in the motor chamber 20 while restricting the liquid refrigerant from being introduced into the compression chamber 27 from the motor chamber 20 through the suction passage 50. This suppresses the introduction of the liquid refrigerant from the motor chamber 20 into the compression chamber 27 through the suction passage 50. This therefore suppresses the compression of the liquid refrigerant in the compression chamber 27.

Figure 5:
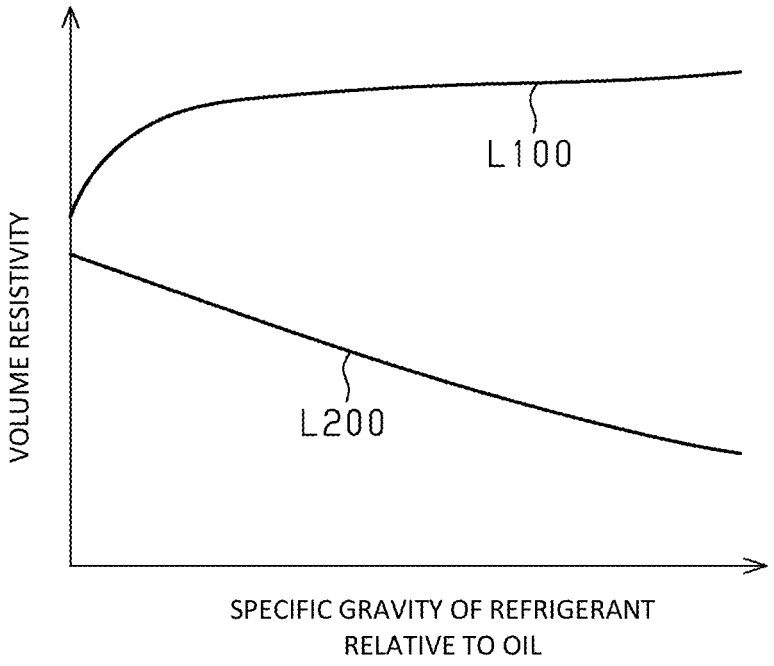
FIG. 5 is a graph for explaining a refrigerant.

FIG. 5 is a graph showing the specific gravity of the refrigerant relative to oil versus the volume resistivity. A solid line L100 indicates the refrigerant when propane serves as the refrigerant. A solid line L200 indicates the refrigerant when fluorocarbon serves as the refrigerant. As indicated by the solid line L100 in FIG. 5, when propane serves as the refrigerant, the electrical insulation property of the refrigerant increases as the specific gravity of the refrigerant relative to the oil contained in the refrigerant increases. As indicated by the solid line L200 in FIG. 5, when fluorocarbon serves as the refrigerant, the electrical insulation property of the refrigerant decreases as the specific gravity of the refrigerant relative to the oil contained in the refrigerant increases.

In such a manner, the inventors have found that, when propane serves as the refrigerant, the electrical insulation property of the refrigerant increases as the specific gravity of the refrigerant relative to the oil contained in the refrigerant increases. That is, since the specific gravity of the refrigerant relative to the oil contained in the refrigerant increases as the liquid refrigerant stored in the reservoir 56 in the motor chamber 20 increases, the electrical insulation property of the refrigerant increases. This prevents poor electrical insulation between the motor 22 and the housing 11 via the liquid refrigerant, even when propane as the liquid refrigerant is stored in the reservoir 56 in the motor chamber 20. Even when fluorocarbon serves as the refrigerant, it is possible to ensure the electrical insulation property of the refrigerant by adjusting the amount of the oil contained in the refrigerant so that the specific gravity of the refrigerant relative to the oil decreases.

The aforementioned embodiment achieves the following advantageous effects.

(1) In the axial view of the rotary shaft 15, a part of the motor chamber 20 below the fourth imaginary line L14 in the vertical direction and surrounded by the inner peripheral surface 12*e* of the motor housing peripheral wall 12*b* and the fourth imaginary line L14 serves as the reservoir 56. This configuration allows the reservoir 56 to store the liquid refrigerant liquified in the motor chamber 20 while restricting the liquid refrigerant from being introduced into the compression chamber 27 from the motor chamber 20 through the suction passage 50. This suppresses the introduction of the liquid refrigerant from the motor chamber 20 into the compression chamber 27 through the suction passage 50. This therefore suppresses the compression of the liquid refrigerant, thereby preventing an abnormal increase in the pressure in the compression chamber 27. Accordingly, this configuration suppresses a decrease in the durability of the compression part C1, thereby increasing the reliability of the electric compressor 10.

(2) In the axial view of the rotary shaft 15, a part of the motor chamber 20 below the fifth imaginary line L15 in the vertical direction and surrounded by the inner peripheral surface 12*e* of the motor housing peripheral wall 12*b* and the fifth imaginary line L15 serves as the reservoir 56. This configuration allows the reservoir 56 in the motor chamber 20 to easily store the liquid refrigerant liquified in the motor chamber 20. This easily suppresses the introduction of the liquid refrigerant from the motor chamber 20 into the compression chamber 27 through the suction passage 50. This therefore further suppresses the compression of the liquid refrigerant in the compression chamber 27.

(3) In the axial view of the rotary shaft 15, a part of the motor chamber 20 below the sixth imaginary line L16 in the vertical direction and surrounded by the inner peripheral surface 12*e* of the motor housing peripheral wall 12*b* and the sixth imaginary line L16 serves as the reservoir 56. This configuration allows the reservoir 56 in the motor chamber 20 to easily store the liquid refrigerant liquified in the motor chamber 20. This easily suppresses the introduction of the liquid refrigerant from the motor chamber 20 into the compression chamber 27 through the suction passage 50. This therefore further suppresses the compression of the liquid refrigerant in the compression chamber 27.

(4) In general, the refrigerant contains oil. The inventors have found that, when propane serves as the refrigerant, the electrical insulation property of the refrigerant increases as the specific gravity of the refrigerant relative to the oil contained in the refrigerant increases. Therefore, the inventors have adopted propane as the refrigerant. That is, since the specific gravity of the refrigerant relative to the oil contained in the refrigerant increases as the liquid refrigerant stored in the reservoir 56 in the motor chamber 20 increases, the electrical insulation property of the refrigerant increases. This prevents poor electrical insulation between the motor 22 and the housing 11 via the liquid refrigerant, even if the liquid refrigerant is stored in the reservoir 56 in the motor chamber 20.

(5) The suction passage 50 is located above the reservoir 56 in the vertical direction. This configuration allows the reservoir 56 in the motor chamber 20 to store the liquid refrigerant liquified in the motor chamber 20.

(6) The suction groove 51 is located above the reservoir 56 in the vertical direction. This configuration allows the reservoir 56 in the motor chamber 20 to store the liquid refrigerant liquified in the motor chamber 20.

(7) The communication hole 52 is located above the reservoir 56 in the vertical direction. This configuration allows the reservoir 56 in the motor chamber 20 to store the liquid refrigerant liquified in the motor chamber 20.

The aforementioned embodiment may be modified as below. The embodiment and the following modification examples may be combined with each other within technically consistent range.

In the embodiment, in the axial view of the rotary shaft 15, a throttle passage in communication with the annular passage 54 may be formed in a portion of the shaft support housing 13 that is located below the fourth imaginary line L14 in the vertical direction. According to this configuration, the throttle passage is designed to have a cross-sectional area that allows restriction of the flow of the liquid refrigerant liquefied in the motor chamber 20. The throttle passage allows the refrigerant to flow after the liquid refrigerant is vaporized.

In the embodiment, in the axial view of the rotary shaft 15, the suction groove 51 may be formed in a portion of the motor housing peripheral wall 12*b* between the fifth imaginary line L15 and the sixth imaginary line L16. In the axial view of the rotary shaft 15, the communication hole 52 may be formed in a portion of the shaft support housing 13 between the fifth imaginary line L15 and the sixth imaginary line L16. In such a configuration, in the axial view of the rotary shaft 15, a part of the motor chamber 20 below the fifth imaginary line L15 in the vertical direction and surrounded by the inner peripheral surface 12*e* of the motor housing peripheral wall 12*b* and the fifth imaginary line L15 serves as the reservoir 56.

In the embodiment, in the axial view of the rotary shaft 15, the suction groove 51 may be formed in a portion of the motor housing peripheral wall 12*b* between the fourth imaginary line L14 and the fifth imaginary line L15. In the axial view of the rotary shaft 15, the communication hole 52 may be formed in a portion of the shaft support housing 13 between the fourth imaginary line L14 and the fifth imaginary line L15. In such a configuration, in the axial view of the rotary shaft 15, a part of the motor chamber 20 below the fourth imaginary line L14 in the vertical direction and surrounded by the inner peripheral surface 12*e* of the motor housing peripheral wall 12*b* and the fourth imaginary line L14 serves as the reservoir 56. That is, in the axial view of the rotary shaft 15, a part of the motor chamber 20 below the fourth imaginary line L14 in the vertical direction and surrounded by the inner peripheral surface 12*e* of the motor housing peripheral wall 12*b* and the fourth imaginary line L14 has to serve as the reservoir 56.

In the embodiment, in the axial view of the rotary shaft 15, the suction groove 51 may be formed in a portion of the motor housing peripheral wall 12*b* located below the fourth imaginary line L14 in the vertical direction. That is, in the axial view of the rotary shaft 15, the communication hole 52 has to be located in a portion of the shaft support housing 13 located above the fourth imaginary line L14 in the vertical direction. In this configuration, in the axial view of the rotary shaft 15, a part of the motor chamber 20 below the fourth imaginary line L14 in the vertical direction and surrounded by the inner peripheral surface 12*e* of the motor housing peripheral wall 12*b* and the fourth imaginary line L14 serves as the reservoir 56. This configuration allows the reservoir 56 to store the liquid refrigerant liquified in the motor chamber 20 while restricting the liquid refrigerant from being introduced into the compression chamber 27 from the motor chamber 20 through the suction passage 50.

In the embodiment, in the axial view of the rotary shaft 15, the suction groove 51 may be formed in a portion of the motor housing peripheral wall 12*b* located below the fourth imaginary line L14 in the vertical direction. In this configuration, in the axial view of the rotary shaft 15, the communication hole 52 may be located in a portion of the shaft support housing 13 located below the fourth imaginary line L14 in the vertical direction. In this configuration, in the axial view of the rotary shaft 15, the suction ports 55 have to be formed in a portion of the fixed scroll peripheral wall 25*c* located above the fourth imaginary line L14 in the vertical direction. In this configuration, in the axial view of the rotary shaft 15, a part of the motor chamber 20 below the fourth imaginary line L14 in the vertical direction and surrounded by the inner peripheral surface 12*e* of the motor housing peripheral wall 12*b* and the fourth imaginary line L14 serves as the reservoir 56. This configuration allows the reservoir 56 to store the liquid refrigerant liquified in the motor chamber 20 while restricting the liquid refrigerant from being introduced into the compression chamber 27 from the motor chamber 20 through the suction passage 50.

In the embodiment, the bolt insertion holes 19*a* may not be formed in the outer peripheral portion of the flange wall 19 of the shaft support housing 13. The flange wall 19 may not be disposed between and held by the discharge housing peripheral wall 14*b* of the discharge housing 14 and the motor housing peripheral wall 12*b* of the motor housing 12. In this configuration, for example, the flange wall 19 may be press-fitted in the inner peripheral surface 12*e* of the motor housing peripheral wall 12*b* of the motor housing 12. This configuration eliminates the need for fastening the shaft support housing 13 to the motor housing 12 by the bolts B1. In this configuration, the shaft support housing 13 does not have the communication hole 52. The suction groove 51 is directly communicated with the communication groove 53.

In the embodiment, the suction groove 51 may not be formed. In this configuration, the diameter of the inner peripheral surface 12*e* of the motor housing peripheral wall 12*b* of the motor housing 12 may be increased as a whole so that the inner peripheral surface 12*e* is connected to the flange wall 19 of the shaft support housing 13.

In the embodiment, each of the suction ports 55 may be a groove formed in the inner peripheral surface of the fixed scroll peripheral wall 25*c*, and may be directly communicated with the communication hole 52.

In the embodiment, the number of suction ports 55 is not particularly limited.

In the axial view of the rotary shaft 15, the suction ports 55 may be formed in a portion of the fixed scroll peripheral wall 25*c* below the fourth imaginary line L14 in the vertical direction.

In the embodiment, carbon dioxide may serve as the refrigerant. As indicated by the solid line L100 in FIG. 5, when carbon dioxide serves as the refrigerant, the electrical insulation property of the refrigerant increases as the specific gravity of the refrigerant relative to the oil contained in the refrigerant increases.

In such a manner, the inventors have found that, when carbon dioxide serves as the refrigerant, the electrical insulation property of the refrigerant increases as the specific gravity of the refrigerant relative to the oil contained in the refrigerant increases. Therefore, the inventors have adopted carbon dioxide as the refrigerant. That is, since the specific gravity of the refrigerant relative to the oil contained in the refrigerant increases as the liquid refrigerant stored in the reservoir 56 in the motor chamber 20 increases, the electrical insulation property of the refrigerant increases. This prevents poor electrical insulation between the motor 22 and the housing 11 via the liquid refrigerant, even if the liquid refrigerant is stored in the reservoir 56 in the motor chamber 20.

In the embodiment, the refrigerant may be, for example, fluorocarbon, and the type of the refrigerant is not particularly limited.

In the embodiment, the compression part C1 is not limited to a scroll compression mechanism. The compression part C1 may be a compression mechanism, such as a piston compression mechanism, a vane compression mechanism, or a rotary compression mechanism.

In the embodiment, the electric compressor 10 is applicable to a vehicle air conditioner, but not limited thereto. That is, the electric compressor 10 needs to compress the refrigerant, but the use of the electric compressor 10 may be modified as necessary.

Supplementary Note

The following will describe technical ideas of the embodiments and the modifications.

1. An electric compressor comprising:

a rotary shaft;

a motor configured to rotate the rotary shaft;

a compression part driven by rotation of the rotary shaft and having a compression chamber for compressing a refrigerant; and a housing having: a motor chamber in which the motor is accommodated and into which the refrigerant is introduced from outside of the electric compressor; and a suction passage through which the refrigerant in the motor chamber is introduced into the compression chamber, the housing rotatably supporting the rotary shaft, wherein the motor chamber is defined by an inner peripheral surface of the housing, and in an axial view of the rotary shaft, a first imaginary line intersects an axis of the rotary shaft in a vertical direction, a second imaginary line intersects the axis of the rotary shaft and is inclined at an angle of 30 degrees to the first imaginary line in one direction along a circumferential direction of the rotary shaft, the second imaginary line intersecting the inner peripheral surface of the housing at a first intersection point located below the axis of the rotary shaft in the vertical direction, a third imaginary line intersects the axis of the rotary shaft and is inclined at an angle of 30 degrees to the first imaginary line in the other direction along the circumferential direction of the rotary shaft, the third imaginary line intersecting the inner peripheral surface of the housing at a second intersection point located below the axis of the rotary shaft in the vertical direction, a fourth imaginary line passes through the first intersection point and the second intersection point and extends in a horizontal direction, and a part of the motor chamber below the fourth imaginary line in the vertical direction and surrounded by the inner peripheral surface of the housing and the fourth imaginary line serves as a reservoir, the reservoir storing the refrigerant liquified in the motor chamber while restricting the refrigerant liquified from being introduced into the compression chamber from the motor chamber through the suction passage.

2. The electric compressor according to supplementary note 1, wherein in the axial view of the rotary shaft, a fifth imaginary line intersects the axis of the rotary shaft and extends in the horizontal direction, and a part of the motor chamber below the fifth imaginary line in the vertical direction and surrounded by the inner peripheral surface of the housing and the fifth imaginary line serves as the reservoir.

3. The electric compressor according to supplementary notes 1 or 2, wherein in the axial view of the rotary shaft, the second imaginary line intersects the inner peripheral surface of the housing at a third intersection point located above the axis of the rotary shaft in the vertical direction, the third imaginary line intersects the inner peripheral surface of the housing at a fourth intersection point located above the axis of the rotary shaft in the vertical direction, a sixth imaginary line passes through the third intersection point and the fourth intersection point and extends in the horizontal direction, and a part of the motor chamber below the sixth imaginary line in the vertical direction and surrounded by the inner peripheral surface of the housing and the sixth imaginary line serves as the reservoir.

4. The electric compressor according to any one of supplementary notes 1 to 3, wherein propane serves as the refrigerant.

5. The electric compressor according to any one of supplementary notes 1 to 3, wherein carbon dioxide serves as the refrigerant.

6. The electric compressor according to any one of supplementary notes 1 to 5, wherein the compression part includes:

a fixed scroll including: a fixed scroll base plate; a fixed scroll spiral wall extending from the fixed scroll base plate; and a fixed scroll peripheral wall extending from the fixed scroll base plate and surrounding the fixed scroll spiral wall, the fixed scroll being fixed to the housing; and an orbiting scroll including: an orbiting scroll base plate facing the fixed scroll base plate; and an orbiting scroll spiral wall extending from the orbiting scroll base plate toward the fixed scroll base plate and meshing with the fixed scroll spiral wall, the orbiting scroll being configured to orbit inside the fixed scroll peripheral wall with the rotation of the rotary shaft, the compression chamber is defined by the fixed scroll base plate, the fixed scroll spiral wall, the orbiting scroll base plate, and the orbiting scroll spiral wall, the housing includes:

a shaft support housing disposed such that the orbiting scroll base plate is located between the fixed scroll base plate and the shaft support housing, the shaft support housing rotatably supporting the rotary shaft, and a motor housing including: a motor housing end wall; and a motor housing peripheral wall having a cylindrical shape and extending from the motor housing end wall, an opening of the motor housing peripheral wall being closed by the shaft support housing so that the motor housing cooperates with the shaft support housing to define the motor chamber, the suction passage is formed in at least the shaft support housing so that the motor chamber is communicated with the compression chamber, and the suction passage is located above the reservoir in the vertical direction.

7. The electric compressor according to supplementary note 6, wherein the suction passage includes:

a suction groove formed in an inner peripheral surface of the motor housing peripheral wall and opening at an open end of the motor housing peripheral wall; and a suction port formed in the fixed scroll peripheral wall, wherein the refrigerant is introduced from the suction groove into the compression chamber through the suction port, and the suction groove is located above the reservoir in the vertical direction.

8. The electric compressor according to supplementary note 7, wherein the housing includes a discharge housing that defines a discharge chamber into which the refrigerant compressed in the compression chamber is discharged, the discharge housing includes: a discharge housing end wall; and a discharge housing peripheral wall having a cylindrical shape, the discharge housing peripheral wall extending from the discharge housing end wall and surrounding the fixed scroll peripheral wall, the discharge chamber is located between the discharge housing end wall and the fixed scroll base plate, the suction passage includes:

an annular passage formed between the fixed scroll peripheral wall and the discharge housing peripheral wall, and communicated with the suction port, and a communication hole formed in the shaft support housing, wherein the suction groove is communicated with the annular passage through the communication hole, and the communication hole is located above the reservoir in the vertical direction.

What is claimed is:

1. An electric compressor comprising:

a rotary shaft;

a motor configured to rotate the rotary shaft;

a compression part driven by rotation of the rotary shaft and having a compression chamber for compressing a refrigerant; and a housing having: a motor chamber in which the motor is accommodated and into which the refrigerant is introduced from outside of the electric compressor; and a suction passage through which the refrigerant in the motor chamber is introduced into the compression chamber, the housing rotatably supporting the rotary shaft, wherein the motor chamber is defined by an inner peripheral surface of the housing, and in an axial view of the rotary shaft, a first imaginary line intersects an axis of the rotary shaft in a vertical direction, a second imaginary line intersects the axis of the rotary shaft and is inclined at an angle of 30 degrees to the first imaginary line in one direction along a circumferential direction of the rotary shaft, the second imaginary line intersecting the inner peripheral surface of the housing at a first intersection point located below the axis of the rotary shaft in the vertical direction, a third imaginary line intersects the axis of the rotary shaft and is inclined at an angle of 30 degrees to the first imaginary line in the other direction along the circumferential direction of the rotary shaft, the third imaginary line intersecting the inner peripheral surface of the housing at a second intersection point located below the axis of the rotary shaft in the vertical direction, a fourth imaginary line passes through the first intersection point and the second intersection point and extends in a horizontal direction, and a part of the motor chamber below the fourth imaginary line in the vertical direction and surrounded by the inner peripheral surface of the housing and the fourth imaginary line serves as a reservoir, the reservoir storing the refrigerant liquified in the motor chamber while restricting the refrigerant liquified from being introduced into the compression chamber from the motor chamber through the suction passage.

2. The electric compressor according to claim 1, wherein in the axial view of the rotary shaft, a fifth imaginary line intersects the axis of the rotary shaft and extends in the horizontal direction, and a part of the motor chamber below the fifth imaginary line in the vertical direction and surrounded by the inner peripheral surface of the housing and the fifth imaginary line serves as the reservoir.

3. The electric compressor according to claim 2, wherein in the axial view of the rotary shaft, the second imaginary line intersects the inner peripheral surface of the housing at a third intersection point located above the axis of the rotary shaft in the vertical direction, the third imaginary line intersects the inner peripheral surface of the housing at a fourth intersection point located above the axis of the rotary shaft in the vertical direction, a sixth imaginary line passes through the third intersection point and the fourth intersection point and extends in the horizontal direction, and a part of the motor chamber below the sixth imaginary line in the vertical direction and surrounded by the inner peripheral surface of the housing and the sixth imaginary line serves as the reservoir.

4. The electric compressor according to claim 1, wherein propane serves as the refrigerant.

5. The electric compressor according to claim 1, wherein carbon dioxide serves as the refrigerant.

6. The electric compressor according to claim 1, wherein the compression part includes:

a fixed scroll including: a fixed scroll base plate; a fixed scroll spiral wall extending from the fixed scroll base plate; and a fixed scroll peripheral wall extending from the fixed scroll base plate and surrounding the fixed scroll spiral wall, the fixed scroll being fixed to the housing; and an orbiting scroll including: an orbiting scroll base plate facing the fixed scroll base plate; and an orbiting scroll spiral wall extending from the orbiting scroll base plate toward the fixed scroll base plate and meshing with the fixed scroll spiral wall, the orbiting scroll being configured to orbit inside the fixed scroll peripheral wall with the rotation of the rotary shaft, the compression chamber is defined by the fixed scroll base plate, the fixed scroll spiral wall, the orbiting scroll base plate, and the orbiting scroll spiral wall, the housing includes:

a shaft support housing disposed such that the orbiting scroll base plate is located between the fixed scroll base plate and the shaft support housing, the shaft support housing rotatably supporting the rotary shaft, and a motor housing including: a motor housing end wall; and a motor housing peripheral wall having a cylindrical shape and extending from the motor housing end wall, an opening of the motor housing peripheral wall being closed by the shaft support housing so that the motor housing cooperates with the shaft support housing to define the motor chamber, the suction passage is formed in at least the shaft support housing so that the motor chamber is communicated with the compression chamber, and the suction passage is located above the reservoir in the vertical direction.

7. The electric compressor according to claim 6, wherein the suction passage includes:

a suction groove formed in an inner peripheral surface of the motor housing peripheral wall and opening at an open end of the motor housing peripheral wall; and a suction port formed in the fixed scroll peripheral wall, wherein the refrigerant is introduced from the suction groove into the compression chamber through the suction port, and the suction groove is located above the reservoir in the vertical direction.

8. The electric compressor according to claim 7, wherein the housing includes a discharge housing that defines a discharge chamber into which the refrigerant compressed in the compression chamber is discharged, the discharge housing includes: a discharge housing end wall; and a discharge housing peripheral wall having a cylindrical shape, the discharge housing peripheral wall extending from the discharge housing end wall and surrounding the fixed scroll peripheral wall, the discharge chamber is located between the discharge housing end wall and the fixed scroll base plate, the suction passage includes:

an annular passage formed between the fixed scroll peripheral wall and the discharge housing peripheral wall, and communicated with the suction port, and a communication hole formed in the shaft support housing, wherein the suction groove is communicated with the annular passage through the communication hole, and the communication hole is located above the reservoir in the vertical direction.

* * * * *